US007793821B2

(12) United States Patent
Oliveira

(10) Patent No.: US 7,793,821 B2
(45) Date of Patent: Sep. 14, 2010

(54) CARTON WITH INTEGRATED TRAY

(75) Inventor: Steven Manuel Oliveira, Nashua, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/396,589

(22) Filed: Mar. 3, 2009

(65) Prior Publication Data

US 2009/0200364 A1 Aug. 13, 2009

Related U.S. Application Data

(63) Continuation of application No. PCT/US2007/019812, filed on Sep. 12, 2007.

(60) Provisional application No. 60/843,978, filed on Sep. 12, 2006.

(51) Int. Cl.
*B65D 17/28* (2006.01)
*B65D 5/42* (2006.01)

(52) U.S. Cl. ..... 229/104; 229/235; 229/242; 229/902; 229/903; 229/906

(58) Field of Classification Search ..... 229/104, 229/120.011, 235, 240, 241, 242, 243, 244, 229/902–904, 906; 219/730, 759; 426/107, 426/109, 110, 113, 114, 122, 123
See application file for complete search history.

(56) References Cited

U.S. PATENT DOCUMENTS 978,569 A * 12/1910 Elkin ..... 229/104
1,651,848 A * 12/1927 Stevens ..... 229/104
1,667,376 A * 4/1928 Fehrenkamp ..... 229/104
1,824,862 A * 9/1931 Young ..... 229/242
2,312,595 A * 3/1943 Smith ..... 229/104
2,363,861 A * 11/1944 Goodyear ..... 229/244
2,565,146 A * 8/1951 Okon ..... 229/104
2,967,610 A * 1/1961 Ebert et al. ..... 229/235
3,107,039 A * 10/1963 Painter ..... 229/104

(Continued)

FOREIGN PATENT DOCUMENTS

WO WO 91/05448 4/1991

(Continued)

OTHER PUBLICATIONS

International Search Report and Written Opinion PCT/US2007/019812 mailed Apr. 24, 2008, Dec. 9, 2007, Graphic Packaging International, Inc.

(Continued)

*Primary Examiner*—Gary E Elkins
(74) *Attorney, Agent, or Firm*—Womble Carlyle Sandridge & Rice, PLLC

(57) ABSTRACT

A carton capable of containing a plurality of food items is disclosed. The carton can be separated into two portions or trays, each of which can be converted into a tray for heating a food item in a microwave oven. One or both of the trays may be designed to elevate the food product from the turntable or floor of the microwave oven to enhance the efficiency of the heating process. One or both trays may include a microwave energy interactive to enhance browning and/or crisping of the food item.

21 Claims, 11 Drawing Sheets

U.S. PATENT DOCUMENTS

| | | | | |
|---|---|---|---|---|
| 4,008,849 | A * | 2/1977 | Baber | 229/237 |
| 4,039,120 | A * | 8/1977 | Herzog | 229/235 |
| 4,815,609 | A * | 3/1989 | Kiedaisch | 229/235 |
| 4,993,625 | A * | 2/1991 | Stease et al. | 229/906 |
| 5,402,931 | A * | 4/1995 | Gulliver et al. | 229/906 |
| 5,582,345 | A * | 12/1996 | Lankhuijzen | 229/235 |
| 5,704,483 | A * | 1/1998 | Groh | 229/104 |
| 6,866,189 | B2 * | 3/2005 | Nelson | 229/242 |
| 7,159,760 | B2 * | 1/2007 | Pluck et al. | 229/902 |
| 7,621,439 | B2 * | 11/2009 | McClure | 229/120.32 |
| 2003/0106926 | A1 * | 6/2003 | Beatificato et al. | 229/104 |
| 2004/0089656 | A1 | 5/2004 | Watkins | |

FOREIGN PATENT DOCUMENTS

| | | | |
|---|---|---|---|
| WO | WO 02/40374 | A1 | 5/2002 |
| WO | WO 2005/085091 | A2 | 9/2005 |

OTHER PUBLICATIONS

Communication Relating to the Results of the Partial International Search mailed Dec. 2, 2008, Dec. 9, 2007, Graphic Packaging International, Inc.

* cited by examiner

CARTON WITH INTEGRATED TRAY

RELATED APPLICATION

This application is a continuation application of prior PCT Application No. PCT/US2007/019812, filed Sep. 12, 2007, entitled "Carton with Integrated Tray," which PCT application claims the benefit of U.S. Provisional Application No. 60/843,978, filed Sept. 12, 2006, entitled "Carton with Integrated Tray," the entire disclosures of both PCT Application No. PCT/US2007/019812 and U.S. Provisional Application No. 60/843,978 are incorporated herein by reference as if set forth in their entireties.

TECHNICAL FIELD

The disclosure generally relates to blanks, cartons and trays. More specifically the disclosure relates to various blanks, constructs, and methods for heating, browning, and/or crisping a food item; and particularly relates to various blanks, constructs, and methods for heating, browning, and/or crisping a food item in a microwave oven.

BACKGROUND

Microwave ovens provide a convenient means for heating a variety of food items, including dough-based products such as pizzas and pies. However, microwave ovens tend to cook such items unevenly and are unable to achieve the desired balance of thorough heating and a browned, crisp crust. Thus, there is a continuing need for a microwavable package that provides the desired degree of heating, browning, and crisping of the crust or dough of a food item.

SUMMARY

The present invention is directed generally to various blanks, constructs formed from such blanks, and methods of making and using such blanks and constructs. The various constructs may be used to contain a plurality of food items for storage, and then may be converted into at least one other construct, for example, a plurality of trays, which may be used for heating each food item in a microwave oven. The converted construct, for example, each tray, may include one or more features that elevate the food item from the turntable and/or interior floor of the microwave oven. As a result, more heat is retained by and/or directed to the food item, rather than being lost to the turntable or the floor of the microwave oven. The various constructs also may include one or more microwave energy interactive elements that further enhance the heating, browning, and/or crisping of the food item in a microwave oven.

In one particular example, the present invention encompasses a blank for forming a carton capable of containing a plurality of food items, for example, two pizzas. The carton can be separated into two portions, each of which can be transformed into a tray for heating one pizza in a microwave oven. The trays may or may not be identical. One or both trays may be designed to elevate the pizza from the turntable or floor of the microwave oven to enhance the efficiency of the heating process. If desired, one or both trays may include a microwave energy interactive element, for example, a susceptor, to enhance browning and/or crisping of the pizza crust.

Other features, aspects, and embodiments will be apparent from the following description and accompanying figures.

BRIEF DESCRIPTION OF THE DRAWINGS

The description refers to the accompanying drawings, some of which are schematic, in which like reference characters refer to like parts throughout the several views, and in which.

DETAILED DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1:
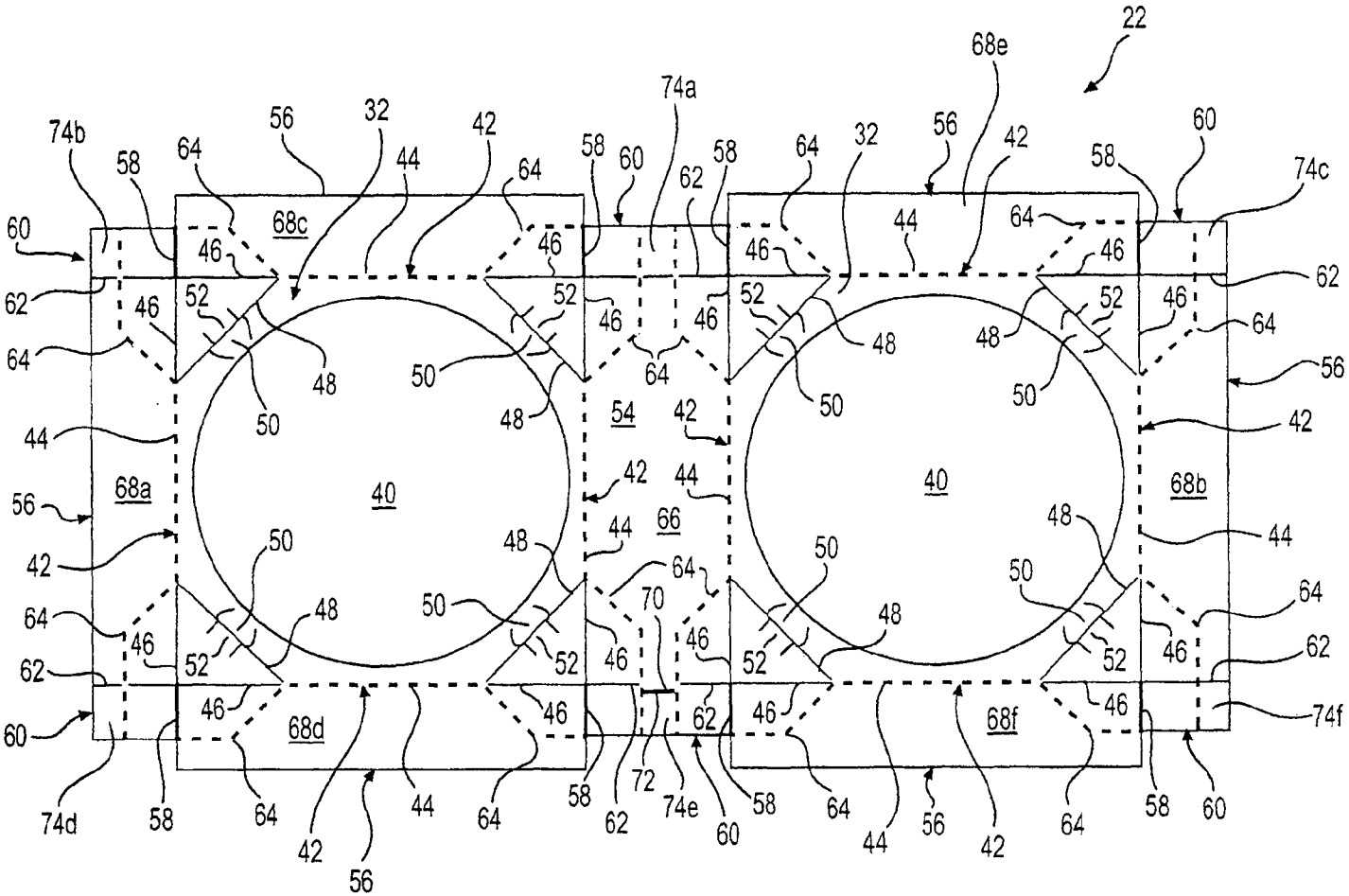
FIG. 1 is a plan view of an inner side of an exemplary blank, according to various aspects of the invention.
Figure 2:
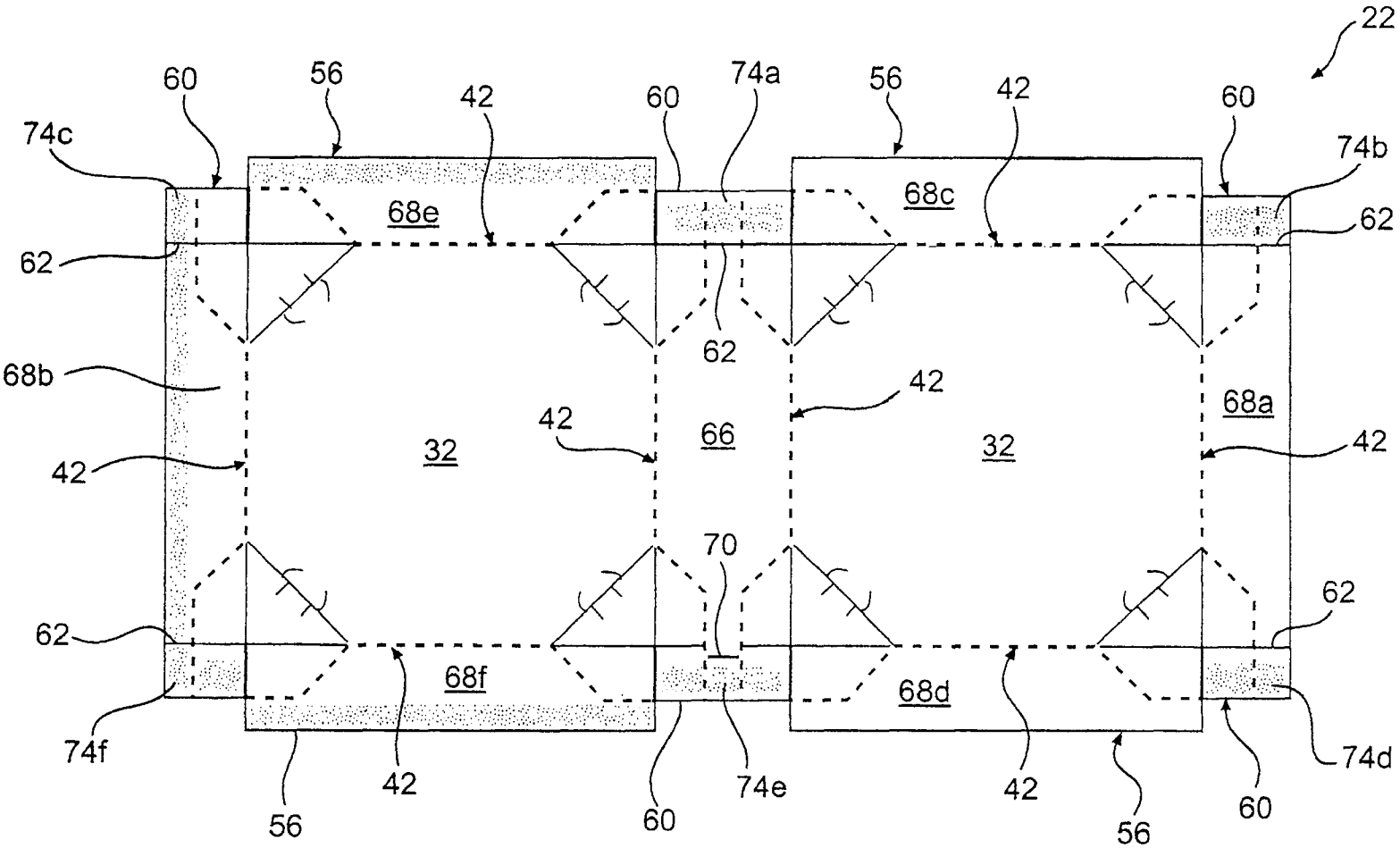
FIG. 2 is a plan view of an outer side of the blank after adhesive material has been applied to portions of the blank, with the adhesive material schematically illustrated by stippling.
Figure 3:
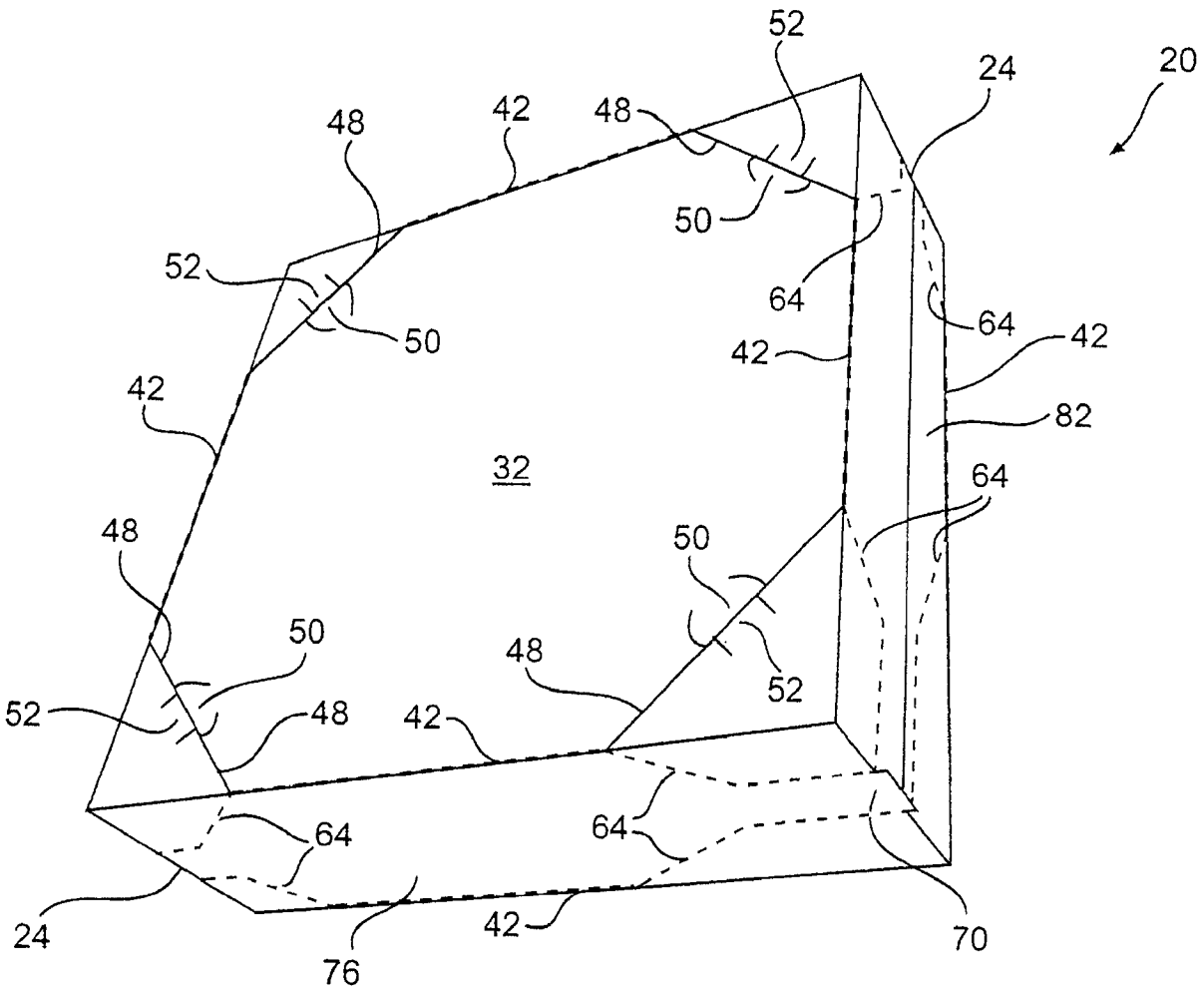
FIG. 3 is a pictorial view of a carton erected from the blank.

In accordance with one aspect of the present invention, a construct, or more specifically, a carton 20 (FIG. 3), can be erected from a blank 22 (FIGS. 1 and 2). The carton 20 can be converted into at least one other construct, or more specifically the carton can be torn along at least one tear line, or the like, to provide one or more remnants of the carton. Even more specifically, a tear strip 24 (FIGS. 3, 4, and 5) of the carton 20 can be torn away from the remainder of the carton so that a lower initial tray (FIG. 6) and/or an upper initial tray (FIG. 7) are remnant(s) of the carton. In this example, the lower initial tray (FIG. 6) and the upper initial tray (FIG. 7) are at least generally alike (except for initially being oppositely oriented), and therefore, for convenience, are each referred to with reference numeral 26. For each of the initial trays 26, the various corners 28 (FIGS. 6 and 7) include walls 30 that extend perpendicularly away from main panel 32 of the tray 26.

Figure 8:
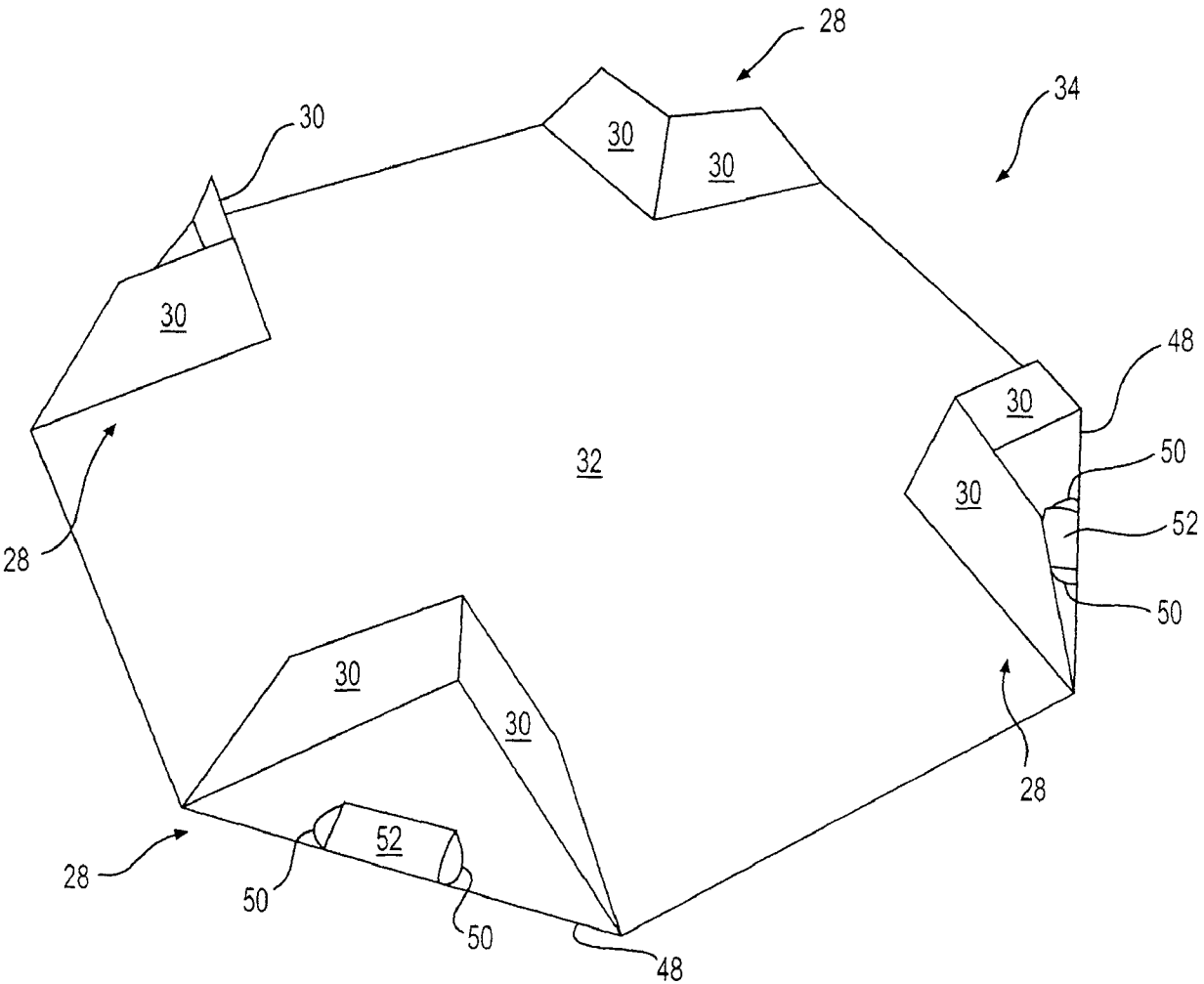
FIG. 8 is a pictorial view of the bottom of a converted tray formed from a representative one of the initial trays.

In accordance with one aspect of the present invention, each of the initial trays 26 can be reconfigured into a converted tray 34 (FIGS. 8, 10, and 11) by repositioning the walls 30 so that they are positioned closer to the center of the main panel 32 of the converted tray 34. More specifically, and for example, a converted tray 34 can be formed by folding the corners 28 of the predecessor initial tray 26 through about 180°, and then locking the corners in their folded configurations, as will be discussed in greater detail below.

Figure 11:
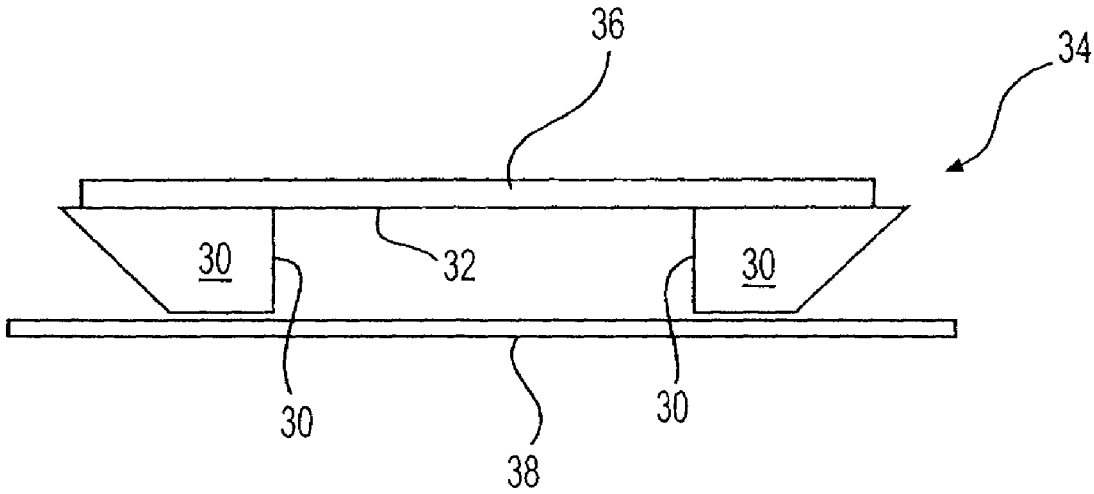
FIG. 11 is a side elevation view of the converted tray supporting a food item above a turntable tray or interior floor of a microwave oven.

As best understood with reference to FIG. 11, the walls 30 of the converted tray 34 can function as supports for supporting the main panel 32 of the converted tray 34 in an elevated configuration. Supporting the main panel 32 in an elevated configuration can be advantageous when the main panel 32 carries food 36 that is being heated, browned, and/or crisped in a microwave oven (not shown). In this elevated configuration, the main panel 32 and the food 36 are spaced apart from the bottom 38 of the cooking chamber of the microwave oven, such that more heat is retained by the food item during the heating process. The bottom 38 can be a turntable of a microwave oven, the interior floor of a microwave oven, or the like.

Numerous materials may be suitable for use in forming the various blank 22 and carton 20 of the invention, provided that the materials are resistant to softening, scorching, combusting, or degrading at typical microwave oven heating temperatures, for example, from about 250° F. to about 425° F. The particular materials used may include microwave energy interactive materials and microwave energy transparent or inactive materials.

Figure 4:
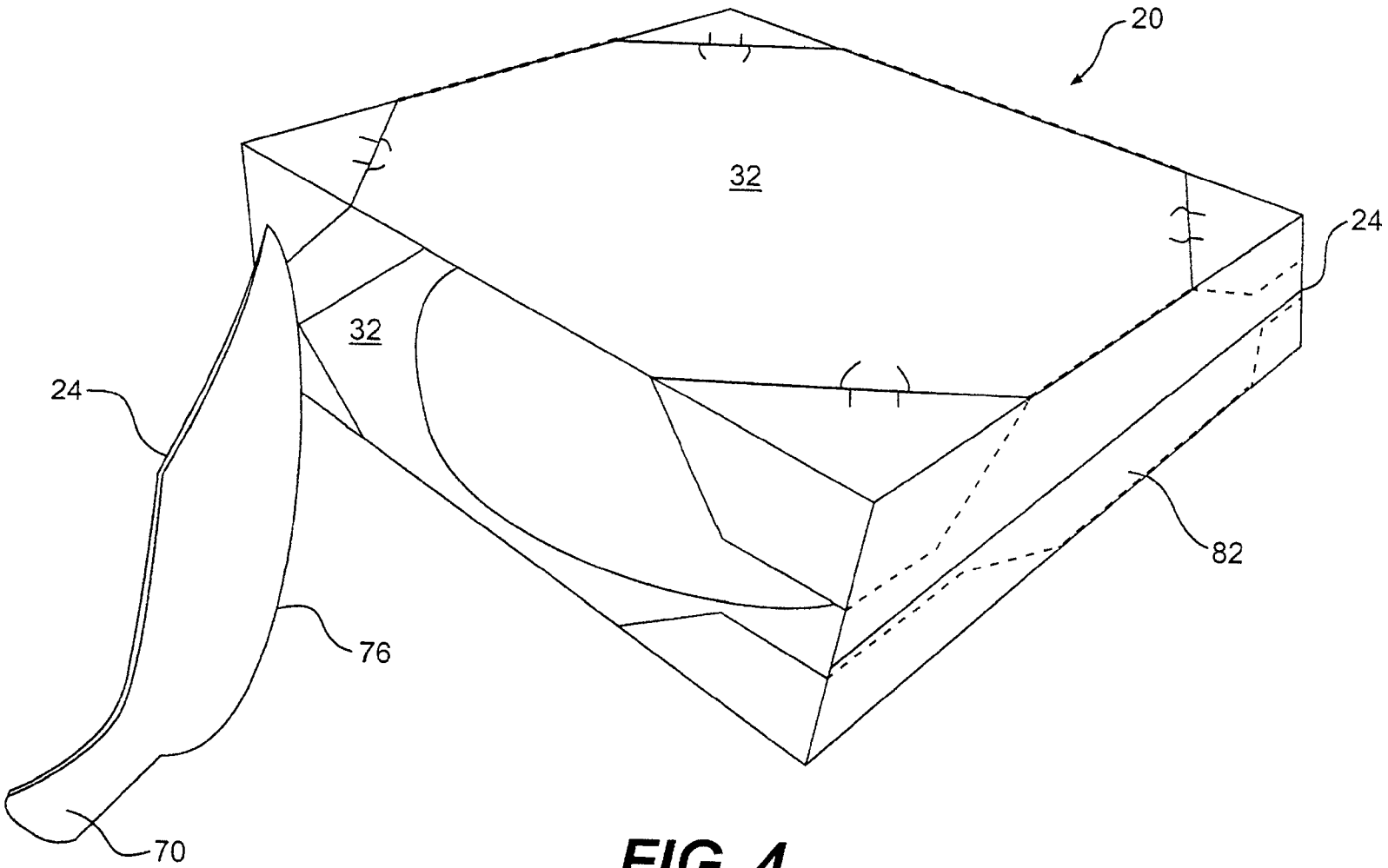
FIG. 4 illustrates the carton with a portion of a tear strip of the carton having been partially torn away from the remainder of the carton.
Figure 6:
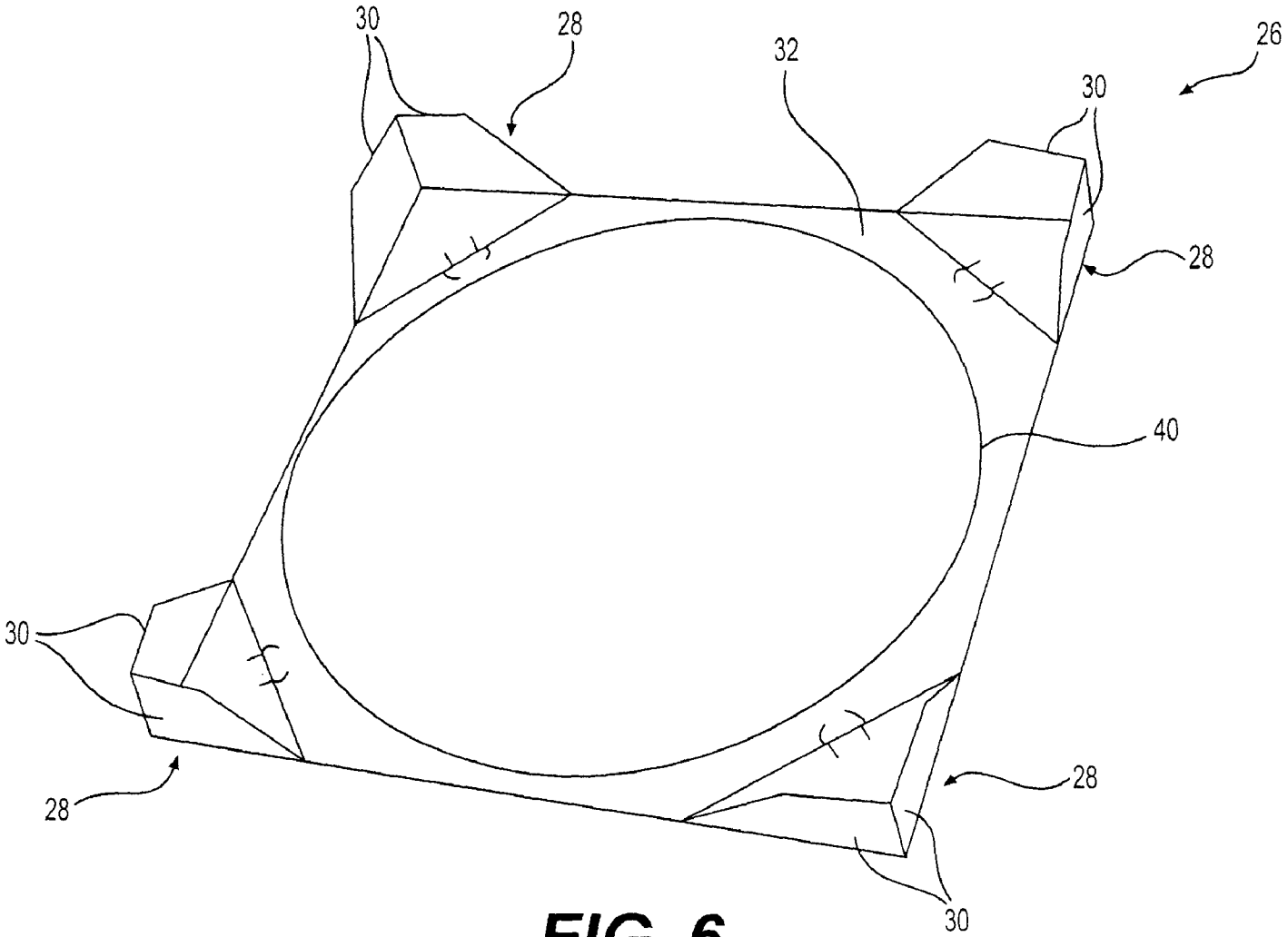
FIG. 6 is a pictorial, isolated view of a lower initial tray that is provided as a remnant of the carton when the tear strip is torn completely away from the remainder of the carton.
Figure 7:
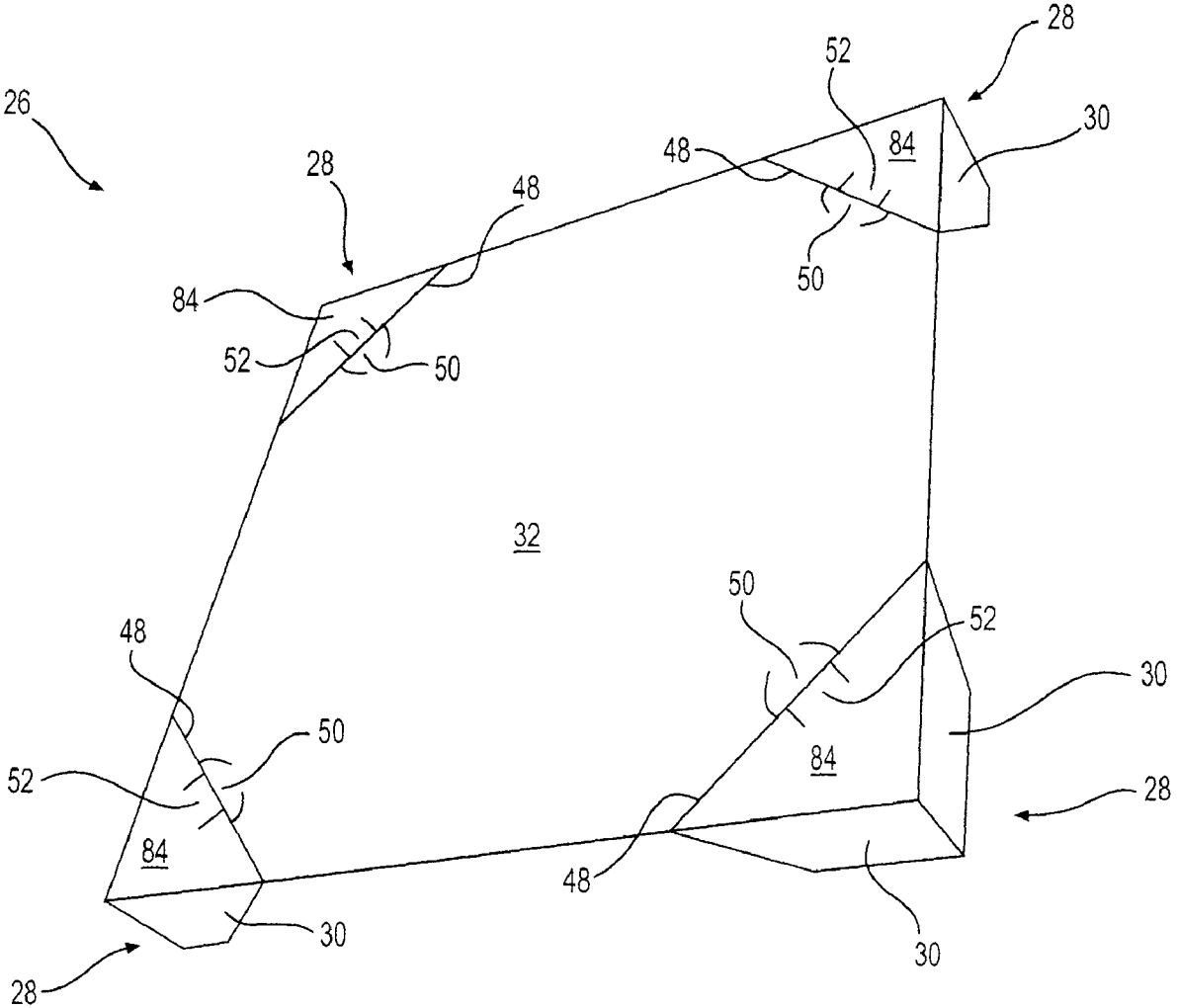
FIG. 7 is a pictorial, isolated view of an upper initial tray that is provided as a remnant of the carton when the tear strip is torn completely away from the remainder of the carton.

In accordance with one aspect of the present invention, all or a portion of the blank 22 or tray 34 may include, or be formed from, one or more features that alter the effect of microwave energy during the microwave heating process. For example, the blank and/or tray may be formed at least partially from one or more microwave energy interactive elements (hereinafter sometimes referred to as "microwave interactive elements") that promote browning and/or crisping of a particular area of the food item, shield a particular area of the food item from microwave energy to prevent overcooking thereof, or transmit microwave energy toward or away from a particular area of the food item. Thus, for example, one or more microwave energy interactive elements 40 may overlie a portion of upper surface of the main panel 32, as shown in FIGS. 1, 4, and 6. As discussed in greater detail toward the end of this disclosure, as one example, the microwave energy interactive elements 40 may be susceptors that substantially cover the central areas of the main panels 32.

Returning to FIG. 1, the inner side of the blank 22 (i.e., the side that will be the inside the carton 20) is shown, with the microwave energy interactive elements 40 shown on the inner side of each main panel 32 of the blank 22. Each of the edges of the main panels 32 is in the form of a line of disruption 42 that includes a substantially straight intermediate tear line 44 that is positioned between and collinear with edge fold lines 46. With regard to the tear line 44, the term "substantially straight" may include lines that are entirely straight, or mostly straight. Corner fold lines 48 extend obliquely across the corners of the main panels 32. Each of the corner fold lines 48 extend from an end of one of the intermediate tear lines 44 to an end of another of the intermediate tear lines 44. A relatively large-headed tab 50 and a relatively narrow-headed tab 52 defined by respective tear lines are centered along and on opposite sides of each of the corner fold lines 48. Alternatively, the tabs 50 and 52 can be defined by continuous slits or by any other suitable mechanism.

An intermediate panel 54 is positioned between and foldably connected to respective edges of the main panels 32 by way of respective lines of disruption 42. Relatively long flaps 56 respectively are connected foldably to the remaining edges of the main panels 32 by way of other respective lines of disruption 42. Slits 58 or other types of cuts respectively extend collinearly from opposite ends of some of the lines of disruption 42 to at least partially define relatively short flaps 60. The relatively short flaps 60 respectively are connected foldably by flap fold lines 62 to the ends of the intermediate panel 54 and the ends of some of the relatively long flaps 56. The flap fold lines 62 extend collinearly from the ends of respective lines of disruption 42.

Crooked tear lines 64 respectively extend from the ends of the intermediate tear lines 44 to the peripheral edges of the blank 22. Each crooked tear line 64 includes an inner portion, which extends obliquely from an end of the respective intermediate tear line 44, and a outer portion, which extends from an end of the inner portion and parallel to the respective intermediate tear line.

The intermediate tear lines 44 and crooked tear lines 64 respectively are cooperative with one another both to partially define a tear-away portion 66 in the intermediate panel 54 and to define at least partially primary tear-away subportions 68*a*-68*f* that are located respectively in the long flaps 56. In accordance with the exemplary embodiment, one end of the tear-away portion 66 in the intermediate panel 54 is in the form of a tab 70 that may be used to grip the carton 20 after being erected from the blank 22, as will be discussed in greater detail below. The tab 70 is partially defined by a slit 72 that is slightly outwardly offset from, yet extends parallel to, the flap fold lines 62 that are adjacent to the tab 70. In this example, the flap fold lines 62 adjacent to tab 70 do not extend into the tab, as will be discussed in greater detail below.

The slit 72 and a respective one of the flap fold lines 62 respectively define the opposite ends of the tear-away portion 66 in the intermediate panel 54. Other of the flap fold lines 62 respectively define ends of the primary tear-away subportions 68*a* and 68*b*. Portions of the outer portions of the crooked tear lines 64 that extend into the short flaps 60, respectively in conjunction with the slit 72 and flap fold lines 62, define secondary tear-away subportions 74*a*-74*f* that are respectively located in the short flaps 60.

FIG. 2 shows the outer side (i.e., the side that will be the outside of the carton 20) of the blank 22. In this example, the outer side of the blank 22 does not include the microwave energy interactive elements 40 that optionally are present on the inner side of the blank 22.

One acceptable method of erecting the carton 20 (FIGS. 3 and 4) from the blank 22 is described in the following primarily with reference to FIG. 2; Adhesive material can be applied to the blank 22 as illustrated schematically with stippling in FIG. 2. That is, the outer side of the blank 22 is shown as including adhesive material in FIG. 2, with the adhesive material being schematically illustrated by stippling and being used for facilitating the adhering discussed immediately below. The adhesive material can be glue or any other suitable adhesive material. Alternatively, the adhesive material can be replaced with, or supplemented by, mechanical fasteners or any other suitable attachment mechanisms.

The blank 22 can be folded along the four lines of disruption 42 that extend laterally across the blank 22, so that the outer side of the primary tear-away subportion 68*b*, which is located at one end of the blank 22, is adhered to the inner side of the primary tear-away subportion 68*a*, which is located at the opposite end of the blank 22, to convert the blank 22 into an at least generally rectangular tube (not shown).

Thereafter, the ends of the tube may be closed by folding the flaps 56 and 60 that are located at the opposite open ends of the tube (with the short flaps 60 being folded first) inwardly and respectively adhering these flaps to one another. One or more food items 36 can be placed in the carton 20 before closing one or both of its open ends. As an example, where the carton 20 is intended to be converted into two remnants, for example, trays, two food items, for example, pizzas, may be placed into the carton 20. However, other numbers of food items and remnants are contemplated hereby.

As best understood with reference to FIGS. 2-5, and as described below in accordance with the exemplary embodiment of the present invention, the carton 20 is erected from the blank 22 so that the tear strip 24 has four links 76, 78, 80, 82 that are respectively foldably connected to one another by the flap fold lines 62. As best understood with reference to FIGS. 2 and 5, the first link 76 of the tear strip 24 includes the tear-away portion 66 along with its tab 70. The second link 78 of the tear strip 24 includes the primary tear-away subportions 68*c* and 68*e* and the secondary tear-away subportions 74*a*, 74*b*, and 74*c* that are adhered together. The secondary tear-away subportions 74*a*-74*f* are hidden from view in FIGS. 3-5. The third link 80 of the tear strip 24 includes the primary tear-away subportions 68*a* and 68*b* that are adhered together. The fourth link 82 of the tear strip 24 includes the primary tear-away subportions 68*d* and 68*f* and the secondary tear-away subportions 74*d*, 74*e*, and 74*f* that are adhered together.

Figure 5:
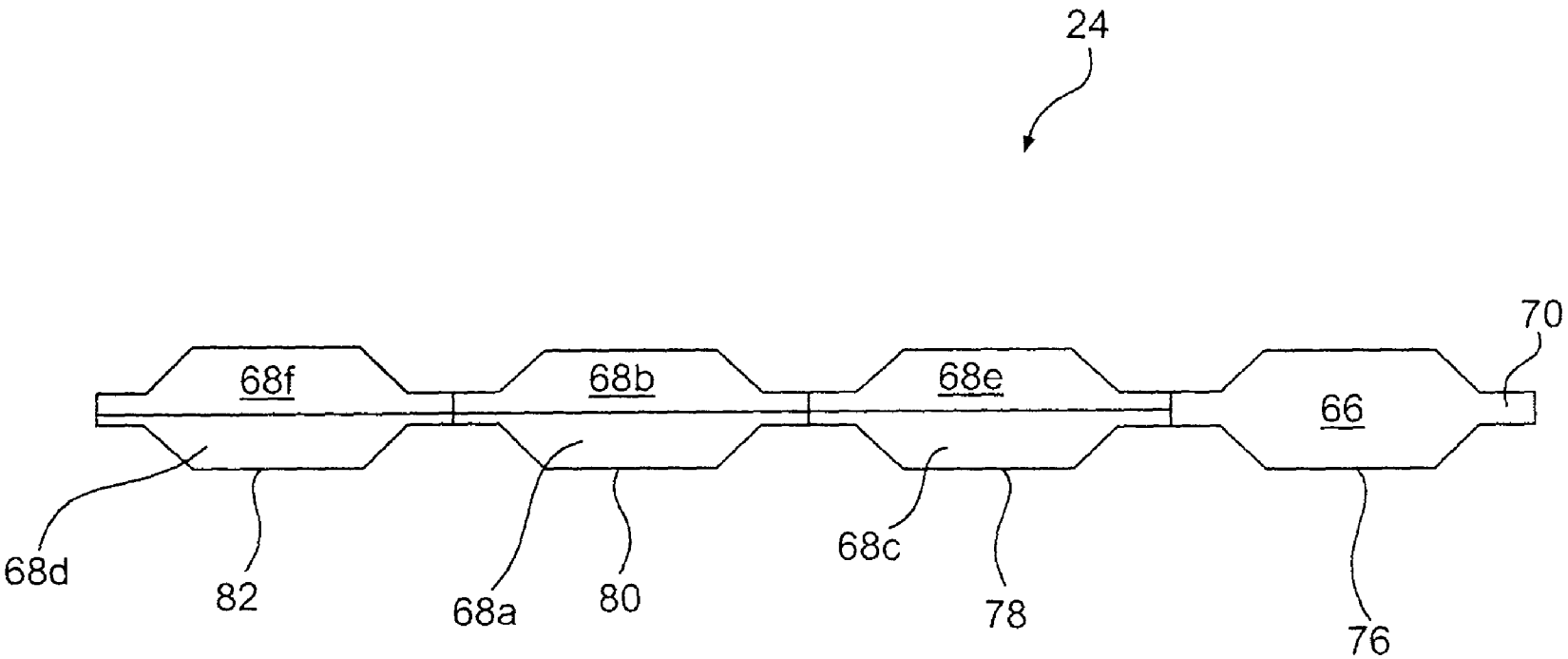
FIG. 5 is a plan, isolated view of the outer side of the tear strip.

As shown in FIG. 5, the overall upper and lower edges of the tear strip 24 each define a generally undulating shape. More specifically, each of the overall upper and lower edges of the tear strip 24 includes an alternating series of edges that extend parallel to the lengthwise/longitudinal direction of the tear strip, and that are respectively connected by an alternating series of obliquely oriented edges.

An acceptable method of tearing the tear strip 24 away from the carton 20 to provide the upper and lower initial trays 26 (FIGS. 7 and 8) follows. As mentioned above with reference to FIG. 1, the tab 70 of the tear strip 24 is partially defined by a slit 72 that is slightly outwardly offset from the adjacent flap fold lines 62 that do not extend across the tab. Therefore, and as best understood with reference to FIG. 3, the free end of the tab 70 projects slightly outwardly from the remainder of the carton 20 to provide a visual cue to the user of the carton 20 that the tab 70 is intended to be grasped and pulled to provide the configuration shown in FIG. 4 (e.g., to open the carton 20 at least partially). By continuing to pull the tab 70, the entire tear strip 24 can be torn from the carton 20 (e.g., to open the carton 20 fully) so that the lower and upper initial trays 26 and tear strip are provided as separate remnants of the carton. As best understood with reference to FIGS. 4-7, the tear strip 24 includes an alternating series of narrow and wide regions such that each of the corners 28 of the initial trays 26 includes a pair of walls 30 that are perpendicular to one another and extend perpendicularly away from the main panel 32 of the tray 26.

An acceptable method of forming a converted tray 34 (FIGS. 8, 10, and 11) from a representative initial tray 26 is described in the following, in accordance with the exemplary embodiment. As best understood with reference to FIGS. 7 and 8, the corners 28 of the initial tray 26 of FIG. 7 can be folded upwardly and inwardly through about 180° respectively about the corner fold lines 48 so that the at least generally triangular surfaces 84 (FIG. 7) of the corners are in opposing face-to-face contact with the side of the main panel 32 that does not include the optional microwave energy interactive element 40. The corners 28 then may be locked in an opposing face-to-face configuration by operating the large-headed tabs 50 and narrow-headed tabs 52.

Figure 9:
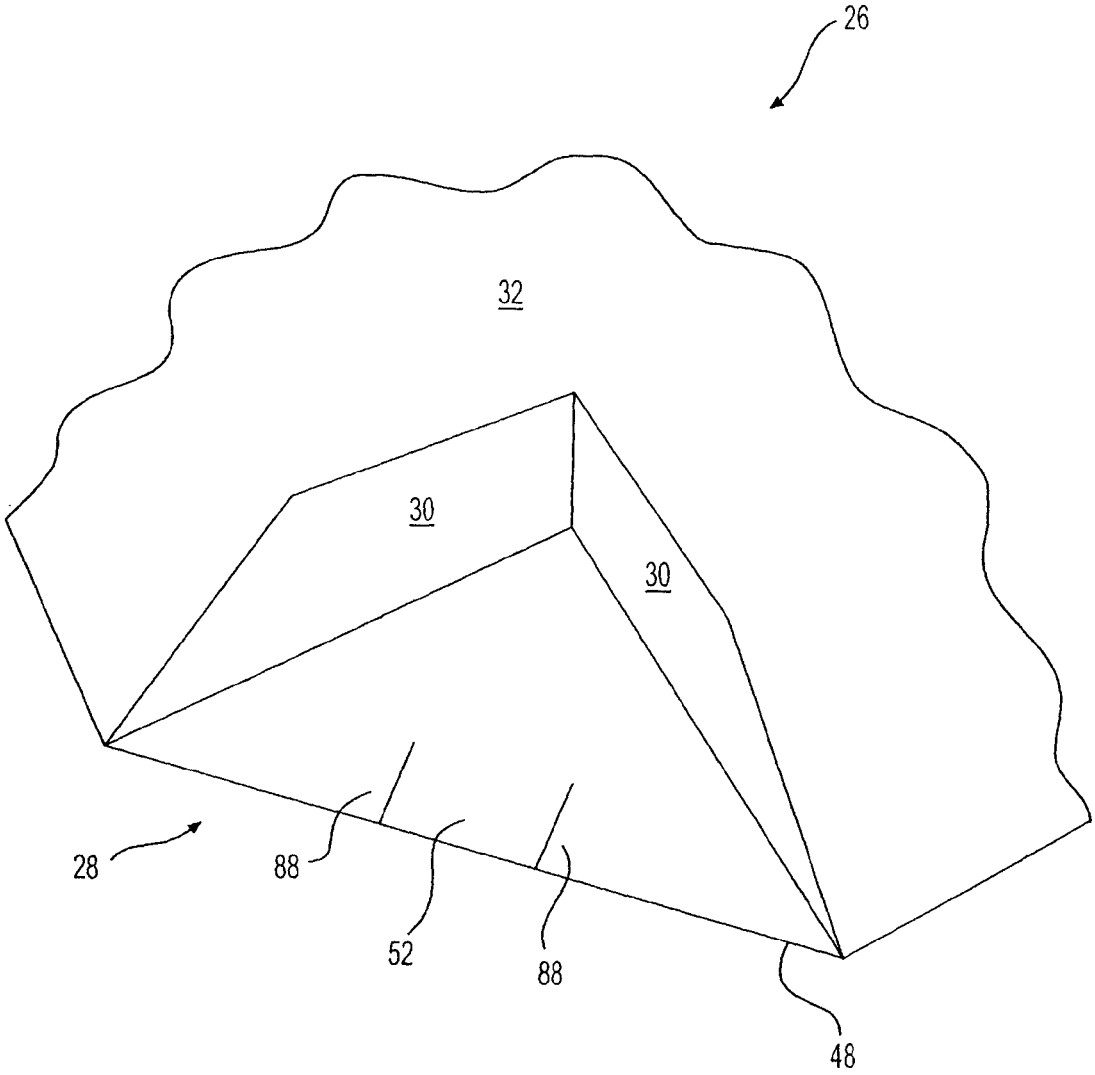
FIG. 9 is a partial view of a corner of a representative one of the initial trays that has been folded over in the process of forming the converted tray.

An acceptable method of locking the corners 28 is described in the following with reference to the representative corner shown in FIGS. 9 and 10. As shown in FIG. 9, the corner 28 has already been folded upwardly and inwardly through about 180° about the associated corner fold line 48, so that the at least generally triangular surface 84 (FIG. 7) of the corner 28 abuts and is in opposing face-to-face configuration with the side of the main panel 32 that does not include the optional microwave energy interactive element 40. In the configuration shown in FIG. 9, the corner 28 is not yet locked in place (e.g., the tear lines that define the associated large-headed tab 50 and narrow-headed tab 52 have not yet been torn). In contrast, the corner 28 is shown locked in place in FIG. 10.

Figure 10:
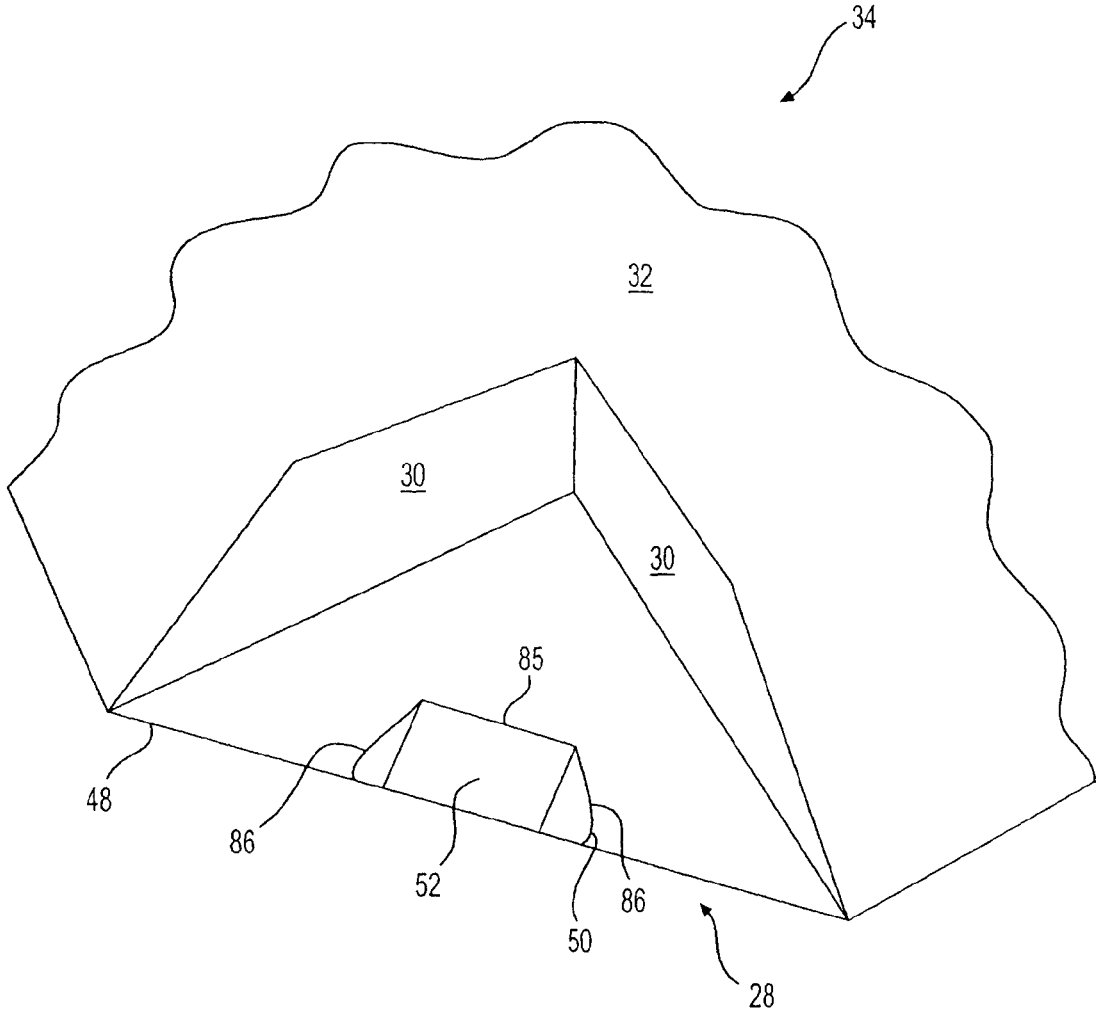
FIG. 10 depicts the corner of FIG. 9 after the corner has been locked into place.

In both of FIGS. 9 and 10, the narrow-headed tab 52 overlaps the large-headed tab 50. To transition from the unlocked state of FIG. 9 to the locked state of FIG. 10, the narrow-headed tab 52 and the large-headed tab 50 can be lifted simultaneously so that their tear lines are torn and they pivot or fold upwardly relative to the remainder of the tray. More specifically, the narrow-headed tab 52 pivots upwardly along the resulting fold line 85 shown in FIG. 10, and the large-headed tab 50 similarly pivots upwardly along a resulting fold line that is parallel to, and hidden from view behind, resulting fold line 85 in FIG. 10. As a result, the large-headed tab 50 temporarily deforms to pass through a slot that was originally occupied by the narrow-headed tab 52. The large-headed tab 50 and the narrow-headed tab 52 then may be released, and the resilience of the material from which the blank 22 is constructed causes the large-headed tab 50 and the narrow-headed tab 52 to move toward their configurations of FIG. 9. The movement of the large-headed tab 50 and the narrow-headed tab 52 toward their respective configurations of FIG. 9 is arrested when opposite lobed marginal portions 86 (FIG. 10) of the large-headed tab 50 engage the arresting surface areas 88 (FIG. 9) of the corner 28, so that the large-headed tab 50 and the narrow-headed tab 52 remain in the locked corner configuration shown in FIG. 10. Alternatively and in theory, the positions of the large-headed tab 50 and the narrow-headed tab 52 could be switched with respect to one another in the blank 22 (with the method of operating them changing accordingly). Other locking mechanisms are also within the scope of the present invention.

An acceptable method of using the converted tray 34 is described in the following with reference to FIG. 11, in accordance with the exemplary embodiment of the present invention. The converted tray 34 can be placed into a microwave oven (not shown), so that the converted tray is upon the bottom 38 of the cooking chamber or on the turntable, if used. More specifically, the converted tray 34 is oriented so that the walls 30 function as supports for supporting the main panel 32 in an elevated configuration with respect to the bottom 38 of the microwave oven. Supporting the main panel 32 in the elevated configuration can be advantageous while cooking, heating and/or browning food 36 (e.g., pizza or any other food item) that is carried by the converted tray 34. In this configuration, walls 30, which are positioned beneath the main panel 32, extend toward the center of and provide support to the main panel 32, thereby increasing the overall rigidity of the converted tray 34.

The remaining tray 26 and food item(s) can be reserved for future use.

In the example shown herein, the construct is somewhat square in shape, suitable, for example, for heating a pizza thereon. However, it will be understood that in this and other aspects of the invention described herein or contemplated hereby, numerous suitable shapes and configurations may be used to form the various panels and, therefore, constructs. Examples of other shapes encompassed hereby include, but are not limited to, polygons, circles, ovals, cylinders, prisms, spheres, polyhedrons, and ellipsoids. The shape of each panel may be determined largely by the shape of the food item, and it should be understood that different packages are contemplated for different food items, for example, sandwiches, pizzas, French fries, soft pretzels, pizza bites, cheese sticks, pastries, doughs, fruit pies, and so forth. The construct may be flexible, semi-rigid, rigid, or may include a variety of components having different degrees of flexibility. Likewise, the construct may include gussets, pleats, or any other feature needed or desired to accommodate a particular food item and/or portion size. Additionally, it will be understood that the present invention contemplates blanks and constructs for single-serving portions and for multiple-serving portions.

Furthermore, it will be understood a fold line can be any at least somewhat line-like arranged, although not necessarily straight, form of weakening that facilitates folding therealong; and a tear line can be any at least somewhat line-like arranged, although not necessarily straight, form of weakening that facilitates tearing therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. More specifically, but not for the purpose of narrowing the scope of the present invention, conventional tear lines include a slit that extends partially into the material along the desired line of weakness, a series of spaced apart slits that extend partially into and/or completely through the material along the desired line of weakness, or any combination of these features.

As a more specific example, one type of conventional tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like.

In accordance with one specific example, each of the tear lines of the present invention is in the form of a series of spaced apart slits that extend completely through the material, with the adjacent slits being spaced apart slightly so that a nick (e.g., a small somewhat bridging-like piece of the material) is defined between the adjacent slits for typically temporarily connecting the material across the tear line. More specifically in accordance with this specific example, each of the intermediate tear lines 44, as well as the outer portions of the crooked tear lines 64 that are not within the short flaps 60, are what can be characterized as "serrated" tear lines (e.g., each slit of these serrated tear lines includes a main slit and a smaller slit that extends obliquely from the main slit), whereas the other tear lines are what can be characterized as "normal" tear lines (e.g., each slit of those normal tear lines includes a main slit, and there are none of the smaller slits that extends obliquely from the main slits). As another specific example, each of the edge fold lines 46 can be a combination of a score line and a kiss cut that is shorter than, collinear with, and centered on the score line.

Furthermore, various exemplary blanks and constructs are shown and described herein as having fold lines, tear lines, score lines, cut lines, kiss cut lines, and other lines as extending from a particular feature to another particular feature, for example from one particular panel to another, from one particular edge to another, or any combination thereof. However, it will be understood that such lines need not necessarily extend between such features in a precise manner. Instead, such lines may generally extend between the various features as needed to achieve the objective of such line. For instance, where a particular tear line is shown as extending from a first edge of a blank to another edge of the blank, the tear line need not extend completely to one or both of such edges. Rather, the tear line need only extend to a location sufficiently proximate to the edge so that the removable strip or panel can be manually separated from the blank or construct without causing undesirable damage thereto.

Referring to the optional microwave interactive elements 40 (FIGS. 1, 4 and 6) in greater detail, each comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs may be referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric vehicle or other suitable matrix or binder, and may include flakes of an electroconductive metal, for example, aluminum.

In one example, the microwave interactive element may comprise a thin layer of microwave interactive material (generally less than about 100 angstroms in thickness, for example, from about 60 to about 100 angstroms in thickness) that tends to absorb at least a portion of impinging microwave energy and convert it to thermal energy (i.e., heat) at the interface with a food item. Such elements often are used to promote browning and/or crisping of the surface of a food item (sometimes referred to as a "browning and/or crisping element"). When supported on a film or other substrate, such an element may be referred to as a "susceptor film" or, simply, "susceptor". In the example illustrated in FIGS. 1, 4, and 6, a substantially circular susceptor "patch" 40 overlies a portion of the main panel 32. However, other microwave energy interactive elements of varying size, shape, and type, such as those described herein, are contemplated for use with the invention.

For example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating. The shielding element may be formed from various materials and may have various configurations, depending on the particular application for which the shielding element is used. Typically, the shielding element is formed from a conductive, reflective metal or metal alloy, for example, aluminum, copper, or stainless steel, in the form of a solid "patch". The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil or high optical density evaporated material (collectively referred to as "segmented foil"), such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors. Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting, and numerous other factors.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

In some instances, it may be beneficial to create one or more discontinuities or inactive regions to prevent overheating or charring of the construct. By way of example, and not limitation, in the tray 34 illustrated in FIGS. 8, 10 and 11, the triangular corner surfaces/support surfaces 84 (FIG. 7) of the main panel 32 and portions of the remainder of the main panel 32 are overlapped and in intimate and/or proximate contact with one another. When exposed to microwave energy, the concentration of heat generated by the overlapped areas may be sufficient to cause the underlying support surfaces 84, in this case, paperboard, to become scorched. As such, the overlapping portions of support surfaces 84 and overlapping portions of the remainder of the main panel 32 may be designed to be microwave energy transparent, for example, by forming these areas of the blank without a microwave energy interactive material, removing any microwave energy interactive material that has been applied, or by deactivating the microwave energy interactive material in these areas.

Further still, one or more panels, portions of panels, or portions of the carton 20 or tray 34 may be designed to be microwave energy inactive to ensure that the microwave energy is focused efficiently on the areas to be browned and/or crisped, rather than being lost to portions of the food item not intended to be browned and/or crisped or to the heating environment.

As stated above, any of the above elements and numerous others contemplated hereby may be supported on a substrate. The substrate typically comprises an electrical insulator, for example, a polymer film or other polymeric material. As used herein, the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a water vapor transmission rate as measured using ASTM F1249 of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form the construct.

In one aspect, for example, where a rigid or semi-rigid construct is to be formed, all or a portion of the support may be formed at least partially from a paperboard material, which may be cut into a blank prior to use in the construct. For example, the support (e.g., the blank 22) may be formed from paperboard having a basis weight of from about 60 to about 330 lbs/ream (lbs/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support (e.g., the blank 22) may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions of the blank or constructs described herein or contemplated hereby may be coated with varnish, clay, or other materials, either alone or in combination. The coating may then be printed over with product advertising or other information or images. The blank or other carton also may be coated to protect any information printed thereon.

Furthermore, the blank or constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. patent application Ser. No. 11/211,858, to Middleton, et al., titled "Absorbent Microwave Interactive Packaging", filed Aug. 25, 2005, both of which are incorporated herein by reference in their entirety. Additionally, the blanks or other constructs may include graphics or indicia printed thereon.

It will be understood that with some combinations of elements and materials, the microwave interactive element may have a grey or silver color this is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

It will be understood by those skilled in the art that while the present invention has been discussed above with reference to exemplary embodiments, various additions, modifications and changes can be made thereto without departing from the spirit and scope of the invention as set forth in the following claims.

I claim:

1. A carton comprising:

a plurality of wall panels comprising two main panels, an intermediate panel positioned between and connected to the main panels, and a plurality of flap panels respectively formed by pairs of first flaps that are folded and adhered together, each of the first flaps being foldably connected to a respective one of the main panels; and a tear strip extending around the carton, the tear strip having an alternating series of narrow and wide regions, and the tear strip being formed by a plurality of removable links connected in series, each of the removable links being disposed in a respective one of the wall panels, and at least one of the removable links of the plurality of removable links comprising a first tear-away portion formed in a flap panel of the plurality of flap panels, wherein the first-away portion is at least partially formed by a first tear-away subportion in one of the first flaps of the flap panel and a second tear-away subportion in the other of the first flaps of the flap panel, the first tear-away subportion at least partially overlapping the second tear-away subportion, wherein the carton is convertible to a first tray and a second tray by removal of the tear strip.

2. The carton of claim 1, wherein upper and lower edges of the tear strip each include an alternating series of edges that extend parallel to a longitudinal direction of the tear strip, and that are respectively connected by an alternating series of edges that are oriented obliquely to the longitudinal direction of the tear strip.

3. The carton of claim 1, comprising:

second flaps foldably connected to opposite ends of some of the first flaps and adhered to others of the first flaps; and secondary tear-away subportions respectively disposed in the second flaps, wherein the secondary tear-away subportions partially form one of the one or more of the removable links.

4. The carton of claim 1, wherein one of the removable links is at least partially formed by a second tear-away portion disposed in the intermediate panel.

5. The carton of claim 4, wherein the one of the removable links comprises a pull tab partially defined by a horizontal slit in the first or second tear-away portion, and wherein the pull tab includes a free end that projects outwardly from the carton to enable the tear strip to be removed by pulling of the pull tab.

6. The carton of claim 1, wherein, upon removal of the tear strip, the first and second trays are separated into a first configuration in which each of the first and second trays comprises:

one of the main panels; and a plurality of corner wall members respectively located at corner areas of the one of the main panels, wherein each of the corner wall members comprises a pair of walls that are perpendicular to each other and extend perpendicularly away from the one of the main panels.

7. The carton of claim 1, wherein the first and second tear-away subportions are at least partially defined by respective first lines of disruption in each of the first flaps and each of the first lines of disruption comprises a first substantially straight tear line and a pair of first crooked tear lines extending from opposite ends of the first substantially straight tear line to edges of a respective one of the first flaps.

8. The carton of claim 7, wherein each of the first substantially straight tear lines is positioned between and collinear with a pair of edge fold lines connecting a respective one of the first flaps to one of the main panels.

9. The carton of claim 7, wherein each of the first crooked tear lines includes:

a first inner segment that extends obliquely from the first substantially straight tear line;

and a first outer segment that extends from the first inner segment, parallel to the first substantially straight tear line.

10. The carton of claim 9, comprising:

a plurality of second flaps respectively connected to ends of some of the first flaps; and a plurality of secondary tear-away subportions respectively defined on the second flaps, wherein the first outer segment of at least one of the first lines of disruption extends into one of the second flaps to at least partially define one of the secondary tear-away subportions.

11. The carton of claim 10, wherein:

one of the removable links of the plurality of removable links comprises a second tear-away portion formed in the intermediate panel; and the second tear-away portion is at least partially defined by a pair of spaced-apart second lines of disruption, each of the second lines of disruption being formed by a second substantially straight tear lines and a pair of second crooked tear lines extending from opposite ends of the second substantially straight tear line.

12. The carton of claim 11, wherein the second tear-away portion is configured to join the first tear-away portions such that the first tear-away portions and the second tear-away portion at least partially form the plurality of removable links of the tear strip.

13. The carton of claim 11, wherein each of the second crooked tear lines includes:

a second inner segment that extends obliquely from the second substantially straight tear line; and a second outer segment that extends from the second inner segment, parallel to the second substantially straight tear line.

14. The carton of claim 13, comprising:

a pair of third flaps respectively connected to ends of the intermediate panel; and a plurality of third tear-away portions respectively defined on the third flaps, wherein each of the second outer segments extends into one of the third flaps to partially define the third tear-away subportions.

15. The carton of claim 14, wherein the first tear-away portion, the secondary tear-away subportions, the second tear-away portion and the third tear-away portions are configured to form the tear strip.

16. A carton comprising:

a plurality of wall panels arranged so that the carton is substantially rectangular, the plurality of wall panels comprises:

(a) two main panels, (b) an intermediate panel positioned between and connected to the main panels, and (c) a plurality of flap panels respectively formed by pairs of first flaps that are folded and adhered together, each of the first flaps being foldably connected to one of the main panels;

a tear strip extending around the carton, the tear strip having an alternating series of narrow and wide regions, and the tear strip being formed by a plurality of removable links connected in series, each of the removable links being disposed in a respective one of the wall panels, wherein one or more of the removable links is at least partially formed by a pair of first tear-away subportions respectively disposed in one of the pairs of the first flaps;

wherein the carton is convertible to a first tray and a second tray by removal of the tear strip and upon removal of the tear strip, the first and second trays are separated into a first configuration in which each of the first and second trays comprises:

one of the main panels, and a plurality of corner wall members respectively located at corner areas of the one of the main panels, wherein each of the corner wall members comprises a pair of walls that are perpendicular to each other and extend perpendicularly away from the one of the main panels; and wherein the carton further comprises a plurality of oblique corner fold lines respectively located at the corner areas of the one of the main panels, whereby the first and second trays can be placed in a second configuration in which each of the corner areas is folded through about 180° about a respective one of the corner fold lines, with respect to the first configuration, such that the each of the corner areas lies underneath the one of the main panels and can support the one of the main panels in an elevated position.

17. The carton of claim 16, comprising first and second tabs located on opposite sides of each of the corner fold lines, wherein the first and second tabs can be partially torn away from the one of the main panels and interlocked so as to lock the corner areas underneath the one of the main panels.

18. A method of converting a carton into at least one other construct, comprising:

providing a carton comprising a tear strip extending around the carton, the tear strip having an alternating series of narrow and wide regions; and removing the tear strip such that the carton is converted into at least a first tray and a second tray, wherein removing the tear strip separates the at least first and second trays such that the at least first and second trays are each configured in a first configuration in which the at least first and second trays each comprise:

a platform, and a plurality of corner wall members respectively located at corner areas of the platform, wherein each of the corner wall members comprises a pair of walls that are perpendicular to each other and extended perpendicularly away from the platform, and a plurality of oblique corner fold lines respectively located at the corner areas of the platform;

the method further comprising placing at least one of the at least first and second trays in a second configuration by folding each of the corner areas through about 180° about a respective one of the corner fold lines with respect to the first configuration such that each of the corner areas lies underneath the platform and can support the platform in an elevated position.

19. The method of claim 18, wherein upper and lower edges of the tear strip each include an alternating series of edges that extend parallel to a longitudinal direction of the tear strip, and that are respectively connected by an alternating series of edges that are oriented obliquely to the longitudinal direction of the tear strip.

20. The method of claim 18, wherein the tear strip is formed by a plurality of removable links connected in series, each of the removable links being disposed on a respective wall panel of the carton.

21. The method of claim 18, wherein the carton comprises at least one microwave energy interactive element disposed on at least one wall panel of the carton.

* * * * *